United States Patent [19]

Kitano et al.

[11] Patent Number: 4,484,467

[45] Date of Patent: Nov. 27, 1984

[54] BEADED EDGE FORMING METHOD AND APPARATUS

[75] Inventors: Mikio Kitano; Hideaki Tobita, both of Toyota; Toshio Uno, Okazaki; Kyoichi Yamaguchi, Aichi; Ichiyoshi Tsuchiya, Okazaki, all of Japan

[73] Assignee: Toyota Jidosha Kabushiki Kaisha, Toyota, Japan

[21] Appl. No.: 454,363

[22] Filed: Dec. 29, 1982

[30] Foreign Application Priority Data

Sep. 22, 1981 [JP] Japan ..... 56-149831

[51] Int. Cl.[3] ..... B21D 19/10

[52] U.S. Cl. ..... 72/379; 72/384; 72/404

[58] Field of Search ..... 72/379, 384, 403, 404, 72/415, 474, 475; 29/243.58

[56] References Cited

U.S. PATENT DOCUMENTS

| | | | |
|---|---|---|---|
| 2,707,510 | 5/1955 | Gershon | 72/379 |
| 3,738,300 | 6/1973 | Saunders | 72/379 |

FOREIGN PATENT DOCUMENTS

| | | | |
|---|---|---|---|
| 51-91867 | 8/1976 | Japan | 72/403 |
| 258639 | 9/1926 | United Kingdom | 72/404 |

*Primary Examiner*—Lowell A. Larson

*Attorney, Agent, or Firm*—Kenyon & Kenyon

[57] ABSTRACT

A beaded edge is formed on a plate member, which has an upstanding outer edge bent with a predetermined radius of curvature, by placing the plate member on a lower die and applying a uniform force against the free edge of the upturned portion at an approximately 45° angle to turn the outer portion inwardly to form an angle of about 45° with the plate member, and then pressing the free edge downward into contact with the plate member while maintaining a substantially constant curvature of the bend region to produce a beaded edge.

6 Claims, 2 Drawing Figures

BEADED EDGE FORMING METHOD AND APPARATUS

BACKGROUND OF THE INVENTION (1) Field of the Invention

The present invention relates to a method of forming a bead on an edge of a plate member, and more particularly to a method of forming a bead on an edge of a structural sheet member such as an automobile body panel or the like. The invention also relates to an apparatus for use in forming a bead on an edge of a plate or sheet member.

(2) Prior Art

It is known to finish an edge portion of a steel plate or sheet, such as an automobile body panel or the like, through hemming or curling the edge portion. Recently, stricter requirements have been imposed in West Germany upon automobile body panel edge forming. For example, the rear edge of a hood or fender panel must be hemmed at a radius of curvature of 2.5 mm R or more, as measured at the outer surface of the panel. With the prior curling process, it has been difficult to continuously carry out curling, with a constant quality of an edge having three dimensions, such as the rear edge of a hood or fender.

SUMMARY OF THE INVENTION

An object of the present invention is therefore to provide a bead forming method in which an edge portion of a sheet or panel member constituting a part of an automobile body is formed with a bead having a desired radius of curvature and uniform quality even if the panel edge has three dimensions.

Another object of the present invention is to provide a bead forming method which facilitates the manufacture of a panel member with beaded edge portion having a desired curvature and uniform quality.

A further object of the present invention is to provide an apparatus for carrying out the above method.

According to the present invention, a method of forming a bead on the edge of a panel member comprises two steps, that is, a preforming step comprising: placing on a lower die a panel member having an upstanding outer edge portion which has been bent to a right angle with a predetermined curvature, abutting a forming surface of a preforming blade against the free edge of said upstanding edge portion, the forming surface being inclined toward the panel member, and moving the preforming blade downwardly so as to cause the forming surface to bend the upstanding outer edge portion of the panel member inwardly; and a hemming step comprising: abutting against the free edge of the inwardly bent upstanding outer edge portion of the panel member an inner portion of the lower surface of a hemming blade, said lower surface having a stepped profile with a lower inner portion and an upper outer portion to provide a bead escape space aligned with the bend curvature of the outer edge portion of the panel member, and moving the hemming blade downward to press the free edge of the outer edge portion down toward the panel member with a bead of predetermined curvature retained at the bend of said outer edge portion.

The apparatus according to the present invention includes a preforming device and a hemming device comprising a lower die, a preforming blade with a forming surface inclined toward the lower die, means for driving the preforming blade, a hemming blade having a stepped lower pressing surface to provide a bead escape space, and means for driving the hemming blade.

These and other objects and features of the present invention will become apparent upon reading the following description of the invention in conjunction with the accompanying drawings, with the understanding that variations and modifications can be made within the scope of the appended claims without departing from the spirit of the invention.

DETAILED DESCRIPTION OF THE INVENTION

According to the present invention, a preforming step is carried out using a preforming device separately from and prior to carrying out a hemming step by a hemming device.

The present invention will be explained in more detail with reference to the drawings.

Figure 1:
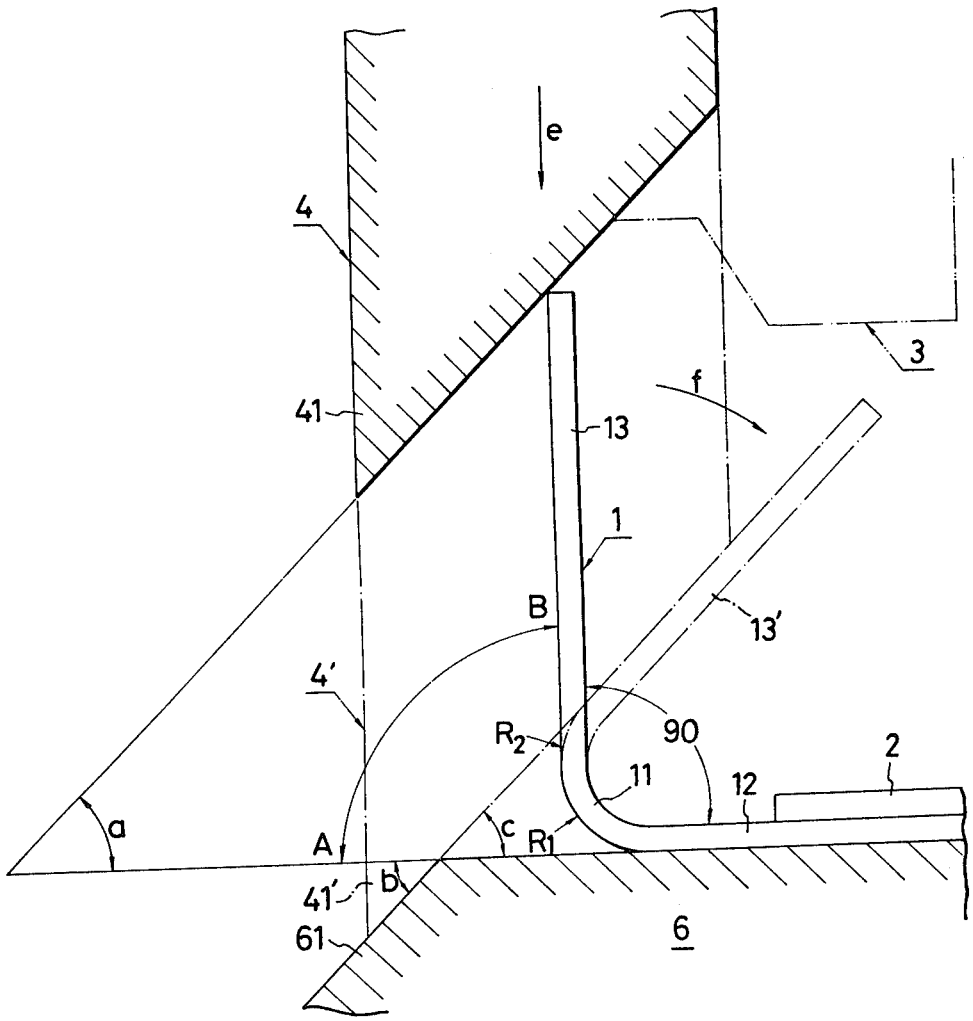
FIG. 1 is a schematic view illustrating a preforming step or preforming device according to the present invention.
Figure 2:
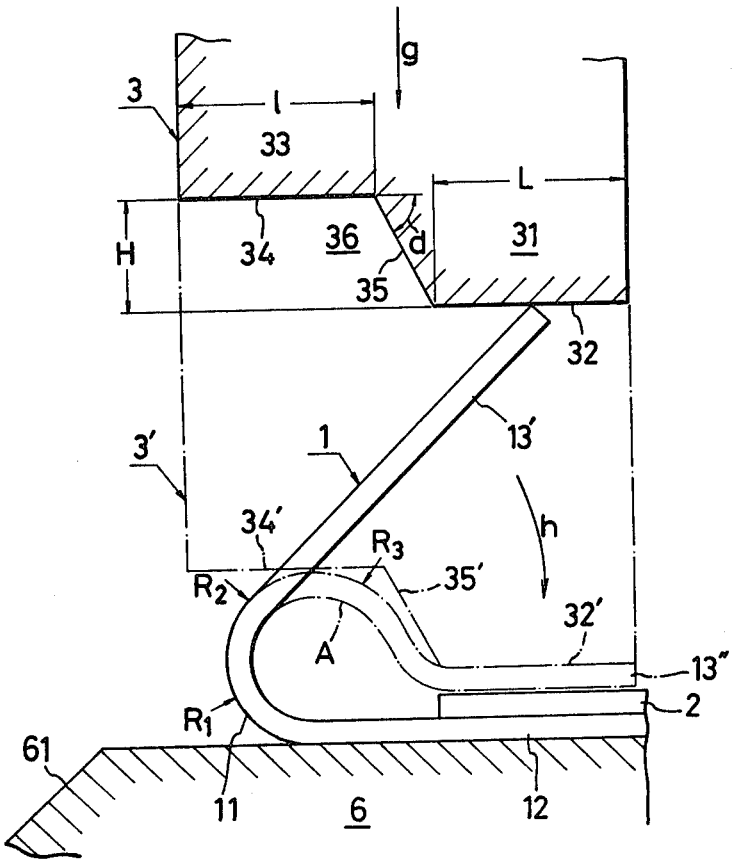
FIG. 2 is a schematic view of a hemming step or hemming device according to the present invention.

FIG. 1 is a diagrammatic cross-sectional view illustrative of a preforming step according to the present invention, and FIG. 2 is a diagrammatic cross-sectional view showing a hemming step according to the present invention.

A workpiece 1 in the form of a steel sheet extending normal to the sheet and to the right of the drawings has a bent portion 11 with a predetermined curvature about an axis normal to the plane of the drawing. The workpiece 1 is bent, for example by press molding, so that the bent portion 11 may have a radius of curvature $R_1$ such as 3.0 mm R, as measured at the outer surface of the steel sheet.

The bent workpiece 1 includes two flat portions bounded by the bent portion 11, one flat portion 12 being placed on a reference surface 60 of a lower die 6 and the other flat portion 13 constituting an upstanding outer edge portion that extends at a right angle to the flat portion 12 and perpendicularly with respect to the reference surface of the lower die 6. Another plate 2 may be placed on the upper surface of the flat portion 12.

A preforming blade 4 has a forming surface 40 disposed in abutment against the free edge of the upstanding outer portion 13, the forming surface being inclined downwardly from the righthand face to the lefthand face of the preforming blade at an angle $a=45°$ with respect to the reference surface of the lower die 6. The preforming blade 4 is positioned such that the free edge of the upstanding flat portion 13 engages the inclined forming surface of the preforming blade 4 substantially at the central axis of the forming surface.

The lower die 6 has a lefthand edge surface 61 inclined downwardly with respect to the reference surface at an angle $b=45°$ equal to the inclined angle of the inclined forming surface 40 of the preforming blade 4. When the preforming blade 4 is lowered, the part of the forming surface 40 adjacent to the lower edge 41 of the preforming blade 4 is brought into abutment against the inclined surface 61 as a stopper to prevent the preforming blade 4 from going further down, thereby minimizing any change in the initial radius of curvature of the bent portion 11.

When the preforming blade 4 is moved downward in the direction of the arrow "e", the forming surface turns the vertical flat portion 13 inward in the direction of the arrow "f". The direction of the arrow "e" in which the preforming blade comes down can be selected within the range defined by the arrows A, B in FIG. 1.

The preforming blade 4 is moved down to and stopped in the position 41' where the part of forming surface 40 adjacent to 41 rests upon the inclined surface 61 of the lower die 6. At this position the upstanding outer edge portion 13 of the workpiece 1 has been turned inward by the forming surface of the preforming blade 4' to become an inclined flat portion 13' which extends at an angle 45° (indicated as "c" in FIG. 1) with respect to the reference surface of the lower die 6. By this preforming step, the bent portion 11 is further extended at a radius of curvature $R_2$ that is substantially equal to the initial radius of curvature $R_1$.

Referring now to FIG. 2, a hemming blade 3 is normally disposed at a position where it does not interfere with the preforming operation; that is, it is outside the turning path of the upstanding outer edge portion 13 in the preforming step.

The bottom of the hemming blade 3 is stepped to provide a workpiece press portion 31 located transversely rightward of the center of the hemming blade 3 and projecting downwardly from a base portion 33 located transversely leftward of the center of the hemming blade. The workpiece press portion 31 (hereinafter referred to simply as a "presser") has a lower surface 32 parallel to the reference surface of the lower die 6, and the base portion 33 has a lower surface 34 that also is parallel to said reference surface. A surface 35 inclined at an angle "d" extends between the lower surface 34 of base portion 33 and lower surface 32 of the presser 31. The inclined surface 35 and the lower surface 34 of the base portion 33 jointly define a bead escape space 36 allowing the pressing of the outer edge portion 13 flat against the plate member 2 by the presser 31, while the bent portion 11 of the workpiece 1 is not pressed, but remains as a beaded edge. The lower surface 32 of the presser 31 has a transverse dimension L large enough to press the outer edge portion 13 flat against the upper surface of the plate member 2 placed on the horizontal flat portion 12 of the workpiece 1.

The vertical distance H between the lower surface 34 of the base portion 33 and the lower surface 32 of the presser 31 is determined on the basis of the relationships between the thicknesses of the plate members 1 and 2 and the derived radius of curvature of the bead to be formed, such that the bead portion to be formed at the bent portion 11 of the workpiece 1 will not be deformed by the hemming blade 3.

The angle "d" of inclination of the inclined side surface 35 is set at 60°. However, it may be in a range of angles that allows the bead escape space 36 to accommodate the bead without compressing the latter. The lower surface 34 of base portion 33 has a width determined such that the bead as formed by the hemming step will be accommodated in the bead escape space 36.

The dimensions and shape of the hemming blade 3 are determined taking into account the material of the workpiece 1, the interval in which the plate member 2 is stacked on the workpiece 1, the radius of the curvature of the bead, the thicknesses of the plate members, and other factors, and should not be interpreted as being limited to the illustrated details. The above-mentioned values will be easily selected by those skilled in the art to which the invention pertains.

For hemming the workpiece 1 by the use of the hemming blade 3, the horizontal lower surface 32 of the presser 31 is moved downward into contact with the free edge of the inclined flat portion 13' of the workpiece 1, which has been inclined at an angle of 45° by the preforming step. At this stage, the free edge of the inclined flat portion 13' contacts a substantially central portion (in the transverse direction) of the lower surface 32 of the presser 31.

When the hemming blade 3 is lowered in the direction of the arrow "g", the inclined flat portion 13' is progressively pressed in the direction of the arrow "h". The hemming blade 3 descends continuously until the inclined flat portion 13' is deformed into a folded flat portion 13'' abutted against the upper surface of the plate member 2, as shown by the dot-and-dash lines. Reference numerals 3', 32', 34' and 35' denote various portions of the hemming blade 3 as stopped in the lowermost position.

As described above, the inclined flat portion 13' of the workpiece 1 is folded onto the upper surface of the plate member 2 under the pressure from the presser 31 of the hemming blade 3. Meanwhile, the bent portion 11 is not directly subjected to the pressure from the hemming blade 3 because it is vertically aligned with the bead escape space 36 in the hemming blade 3. Accordingly, when the hemming blade 3 is moved down to fold the portion 13'' flat against the upper surface of the plate member 2, there is formed a bead A having a radius of curvature $R_3$ greater than the total thicknesses of the plate member 2 and the folded flat portion 13''.

Since the surface 35 of the hemming blade 3 which defines the bead escape 36 is inclined, it does not impose an undue force on the bent portion 11, and the radius of curvature $R_3$ is rendered substantially equal to the radii of curvature $R_1$, $R_2$ that have been given in the preforming step. According to the embodiment of the invention, in case the radius of curvature of the bent portion of the workpiece as originally placed on the lower die is 3.0 mm R, as measured at the outer surface of the plate member, the radius of curvature of the bead of the workpiece as hemmed will be 3.0 mm R to 2.5 mm R on account of a sink at the bent portion.

With the foregoing method, the workpiece 1 can be bent in the preforming step by a preforming blade, having a forming surface extending at an angle of 45° with respect to the upstanding outer edge portion 13 of the workpiece 1, to continue the bent portion 11 with a radius of curvature $R_2$ which is substantially equal to the radius of curvature $R_1$ that was initially given to the bent portion 11. This allows the bead A to have an outer peripheral smooth surface which is semicircular in cross section. In the hemming step, the workpiece 1 is bent further by a stepped hemming blade 3, having a bead escape space 36, to press the outer edge portion of the workpiece 1 flat onto the upper surface of the plate member 2, without pressing the curved bent portion 11. The bead A thus formed has an inner peripheral surface smoothly curved without being compressed. Even where the workpiece 1 and the plate member 2 are steel plates extending normal to the plane of the drawing and varying three-dimensionally in shape, a bead A of uniform quality can be formed on the edge of the workpiece 1, since the hemming blade 3 with the bead escape space 36 extends longitudinally along the workpiece 1 and the plate member 2 (in the direction perpendicular to the plane of the drawings).

An apparatus according to the present invention will be explained by way of example with reference to FIGS. 1 and 2.

The apparatus comprises the lower die 6, the preforming blade 4, means (not shown) for driving the preforming blade in a vertical path between the limits defined by the full-line and broken-line positions in FIG. 1, the hemming blade 3, and means (not shown) for driving the hemming blade in a vertical path between the full-line and broken line positions in FIG. 2. The preforming blade 4 and hemming blade 3 are positioned over the lower die 6 and are disposed or displaced in such a manner that each will not interfere with the respective operation of the other. As explained above, the lower die has an inclined surface 61, while the preforming blade has the correspondingly inclined forming surface 40. The hemming blade has a surface 34 parallel to the horizontal surface of the lower die, a lower surface 32, and an inclined surface 35 connecting surfaces 32 and 34. The surfaces 34 and 35 define the bead escape space 36.

Since operation of the apparatus has been explained in connection with the method according to the present invention, further explanation thereof is omitted.

While in the illustrated embodiment the method and apparatus have been described as forming a bead while a plate member is placed on another plate member to form a laminated structural member, such as for an automobile body panel, the present invention is not limited to the foregoing embodiment. For example, a single plate member may be folded on itself into two layers while forming a bead.

As described above, the bead forming method and apparatus according to the present invention are capable of forming beads of large radii of curvature, which have not been obtained by the conventional methods and apparatus, and it also can form beads of constant quality from plate members having a three-dimensional edge.

We claim:

1. A method of forming a beaded edge on a plate member, the method comprising in sequence a preforming step and a hemming step, wherein the preforming step comprises placing a plate member on a lower die surface, the plate member having an upstanding outer edge portion bent to approximately a right angle with respect to the plate member, the bend region having a predetermined radius of curvature greater than the thickness of the plate member; applying a first uniform force along the free edge of the upstanding outer edge portion, the first uniform force being directed toward the plate member at approximately a 45° angle and at a strength sufficient to turn the outer edge portion while leaving the bend region unconfined; and terminating said force when the outer edge portion forms an angle of approximately 45° with the plate member while retaining said radius of curvature at the bend region; and the hemming step comprises applying a second uniform force along the free edge of the outer edge portion, said second force being directed toward the plate member at approximately a 90° angle and at a strength sufficient to press the free edge of said outer edge portion toward the plate member, and further applying a force parallel to said second force to a part of the outer edge portion lying outside the boundary of a circle congruent with a convex surface of the plate member in the bend region and having a radius equal to said predetermined radius of curvature to fold said part of the outer edge portion parallel to the plate member while retaining said curvature at the bend region to provide a beaded edge to said plate member.

2. The method of claim 1, wherein the preforming step comprises abutting against the free edge of said upstanding outer edge portion a forming surface inclined at approximately 45° with respect to the surface of the lower die and moving the forming surface toward the bend region of the edge portion until said forming surface is tangent to a circle congruent with the convex surface of the plate member in the bend region and having a radius equal to said predetermined radius of curvature of the bend region.

3. The method of claim 1 or 2, wherein the hemming step comprises abutting against the free edge of the plate member subsequent to the preforming step a press surface parallel to the surface of the lower die, said press surface having an outer edge closely adjacent to the contacted free edge of the plate member and located outside the boundary of said circle congruent with the convex surface of the plate member in the bend region to provide a bead escape space vertically aligned with the curved bend region of the outer edge portion of the plate member, and moving the press surface downward until the press surface fully contacts the exposed surface of the outer edge portion of the plate member.

4. The method of claim 1 or 2, wherein another plate member is disposed between the outer edge portion of the plate member and the plate member, as preformed and hemmed.

5. An apparatus for forming a beaded edge having a predetermined radius of curvature on a plate member, the apparatus comprising a lower die having an approximately horizontal die surface and an edge surface inclined downwardly at approximately 45° along one side of the die surface, a preforming blade having a forming surface inclined at approximately 45° toward the die surface and vertically aligned above the inclined edge surface of the lower die, the preforming blade being movable toward the lower die until a lower portion of the forming surface contacts the inclined edge surface of the lower die, and a hemming blade having upper and lower stepped bottom surfaces and an inclined surface provided between the stepped surfaces, the lower stepped bottom surface being a pressing surface disposed parallel to the horizontal die surface of the lower die, the inclined surface of the hemming die intersecting the lower bottom surface at an outer edge of the pressing surface located in a vertical plane lying closely adjacent to but outside the boundary of a circle having a radius equal to said predetermined radius of curvature and tangent to the die surface of the lower die and to a plane containing the inclined edge surface of the lower die, the upper stepped surface and the inclined surface defining a bead escape space located above the horizontal pressing surface, and the hemming blade being movable in a vertical path toward the die surface of the lower die for pressing a folded edge flat against a plate member while the upper stepped surface and the inclined surface remain outside the boundary of said circle.

6. A method of forming a beaded edge on a plate member, the method comprising in sequence a preforming step and a hemming step, wherein the preforming step comprises placing a plate member on a lower die surface, the plate member having an upstanding outer edge portion bent to approximately a right angle with respect to the plate member, the bend region having a predetermined radius of curvature greater than the thickness of the plate member; applying a forming die surface along the free edge of the upstanding outer edge portion, the forming die surface being substantially straight in cross section and making an angle of approximately 45° with the lower die surface; moving the forming die surface toward the bend region of the plate member so that the upstanding outer edge portion is progressively bent toward an adjacent part of the plate member; and stopping movement of the forming die surface when said preforming die surface is tangent to a circle congruent with and having a radius equal to said predetermined radius of curvature of said bend region to turn the outer edge portion to form an angle of approximately 45° with the plate member while retaining said radius of curvature at the bend region; and the hemming step comprises applying a hemming die surface along the free edge of the outer edge portion, the hemming die surface being approximately parallel to the lower die surface; moving the hemming die toward the lower die surface until the free edge of the outer edge portion of the plate member contacts the plate member, the hemming die surface having an outer edge that contacts the exposed surface of the bent over outer edge portion outside the boundary of a circle congruent with and having a radius equal to said predetermined radius of curvature of the bend region, such that the bend region of the outer edge portion of the plate member is unconfined during said preforming and hemming steps, thereby retaining said radius of curvature at the bend region to provide a beaded edge to said plate member.

* * * * *